US006896401B2

(12) United States Patent
Wölfert et al.

(10) Patent No.: US 6,896,401 B2
(45) Date of Patent: May 24, 2005

(54) METHOD AND DEVICE FOR REDUCING BYPRODUCTS IN THE MIXTURE OF EDUCT STREAMS

(75) Inventors: Andreas Wölfert, Bad Rappenau (DE); Ulrich Penzel, Tettau (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 114 days.

(21) Appl. No.: 10/312,285

(22) PCT Filed: Jun. 29, 2001

(86) PCT No.: PCT/EP01/07502

§ 371 (c)(1),
(2), (4) Date: Dec. 20, 2002

(87) PCT Pub. No.: WO02/02217

PCT Pub. Date: Jan. 10, 2002

(65) Prior Publication Data

US 2004/0091406 A1 May 13, 2004

(30) Foreign Application Priority Data

Jul. 3, 2000 (DE) ..... 100 32 269

(51) Int. Cl.[7] ..... B01F 5/02

(52) U.S. Cl. ..... 366/162.4; 366/173.2; 366/178.1; 422/224; 560/347

(58) Field of Search ..... 366/162.4, 162.5, 366/173.2, 178.1, 178.2, 178.3, 181.6; 422/224; 560/347

(56) References Cited

U.S. PATENT DOCUMENTS

| | | | | |
|---|---|---|---|---|
| 2,424,654 A | * | 7/1947 | Gamble | 48/189.4 |
| 3,332,442 A | * | 7/1967 | Reed | 137/896 |
| 3,507,626 A | | 4/1970 | Van Horn | |
| 3,781,320 A | * | 12/1973 | Irwin | 560/347 |
| 3,947,484 A | | 3/1976 | Mitrowsky et al. | |
| 4,289,732 A | | 9/1981 | Bauer et al. | |
| 4,474,477 A | * | 10/1984 | Smith et al. | 366/165.5 |
| 4,851,571 A | | 7/1989 | Sauer et al. | |
| 4,915,509 A | | 4/1990 | Sauer et al. | |
| 5,117,048 A | | 5/1992 | Zaby et al. | |
| 5,931,579 A | | 8/1999 | Gallus et al. | |

FOREIGN PATENT DOCUMENTS

| | | |
|---|---|---|
| DE | 1792660 B2 | 3/1972 |
| DE | 2153268 B2 | 5/1973 |
| DE | 3717057 C2 | 12/1988 |
| EP | 0 291819 B1 | 11/1988 |
| EP | 0471268 A1 | 2/1992 |
| EP | 0 830 894 B1 | 3/1998 |
| GB | 1060540 | 3/1967 |
| GB | 1238669 | 7/1971 |

* cited by examiner

*Primary Examiner*—David Sorkin
(74) *Attorney, Agent, or Firm*—Fernando A. Borrego

(57) ABSTRACT

In a process for mixing reactant streams (1, 2; 5) to produce a product stream (10) using a mixing configuration (15, 16) having a number of reactant feed points, an excess component stream of one reactant is divided into two reactant substreams (1, 2) and fed into the suction region (3, 4) of a mixing space (12) at right angles to a deficient component (5) entering the mixing space (12).

14 Claims, 3 Drawing Sheets

METHOD AND DEVICE FOR REDUCING BYPRODUCTS IN THE MIXTURE OF EDUCT STREAMS

The present invention relates to a process and an apparatus for reducing by-product formation in the mixing of at least two reactant streams, for example in the preparation of organic monoisocyanates or polyisocyanates by mixing monoamines or polyamines with phosgene at elevated temperatures.

In the mixing of amine and phosgene, to name but two reactants by way of example, the reaction of the amine, which is present in solution in an organic solvent, can result in formation of not only isocyanate but also intermediates, for example the undesirable by-product urea. These by-products are obtained as a solid deposit on the wall of the reaction vessel. By-product formation can occur particularly when there is backflow in the mixing apparatus, since product-rich fluid then comes into contact with reactant-rich fluid. One possible way of avoiding undesirable by-product formation is to employ a very high excess of phosgene in the reaction with the amine. However, because of the high toxicity of phosgene, an excess of phosgene in the reaction is highly undesirable.

Deposition or, at relatively high mixing temperatures, possible caking of reactants on the surfaces of the mixing space can be avoided by high dilution of the reactants. High dilution of the reactants in turn incurs higher work-up costs for the product in the next process stage and is therefore only an unsatisfactory alternative. Furthermore, in the mixing of two or more components in the liquid phase, the resulting pressure drops in the mixing apparatus, which have a not inconsiderable effect on the mixing energy which has to be employed due to an increase in turbulent diffusion processes, are also of significance.

For this reason, known mixing apparatuses for mixing reactant streams can be divided into mixing apparatuses having static components and apparatuses having moving components. Mixing apparatuses having moving parts have been disclosed, for example, in DE-B-2 153 268 or U.S. Pat. No. 3,947,484 or as rotor/stator mixing apparatuses in EP-0 291 819 B1 and DE-37 17 057 C2. If a highly toxic substance such as phosgene is being processed, the bearings of moving components of such mixers present a potential point of escape of the phosgene into the environment and thus a high safety risk.

These risks are avoided by mixing apparatuses without moving components. An example of a static mixing apparatus is the perforated ring nozzle known from EP-0 322 647 B1. When using a perforated ring nozzle as static mixing device, the cross-sectional area of one of the two reactant streams is reduced. The other reactant stream is introduced in the form of a multiplicity of small jets generated by the holes arranged in the form of a ring into the narrowed jet. The main disadvantage of the use of a ring nozzle is, however, the fact that deposition of solids in individual holes can lead to reduced flow through the hole. The total volume flow from all holes of the ring nozzle is set via a regulating device and remains constant since greater flow occurs through the remaining holes. However, the decrease in the flow results in further deposition of solids, so that blockage of one of a multiplicity of holes generally occurs earlier.

DE-A 29 50 216 relates to an alternative to a perforated ring nozzle, namely a cylindrical mixing space into which fan-like spray jets are introduced. Owing to the high admission pressures necessary for the method, and also blockages which can occur as a result of attachment and buildup of the liquid phases on the walls of the mixing space and have in practice been found to occur, this procedure is unsatisfactory.

U.S. Pat. No. 3,507,626 is related to a Venturi mixer. A Venturi mixer especially adapted for mixing phosgene with amine to produce an isocyanate having a first conduit with a first inlet, second inlet and an outlet. The conduit has a Venturi section formed by a converging section, a throat section and a diverging section. A second conduit is coaxially disposed with in the first conduit as the first inlet. The second conduit has a tapered section that concurs with the converging section of the Venturi section and terminates in a dispersing means for transversely dispersing fluid therefrom into the surrounding chamber section of the Venturi section. The mixer insures mixing and prevents plugging due to the formation of side reaction products. With this solution it is possible to use a conduit facing a stream-lined conical baffle in lieu of the holes drilled in the conduit to accomplish the same purpose. However caution must be exercised since good results can not be obtained using a baffle, even if it had a stream-lined conical shape unless the baffle has the convex space facing the opening of the conduit which has a concave mouth to complement the base of the baffle. If a baffle is used, the space between the baffle and conduit is restricted depending on the size of the unit so that effective mixing can be achieved. Therefore, if the opening is to great the amine will flow rather then spray out and inefficient mixing with a great deal of back splashing results while in the opening between the baffle and the conduit is to small, plugging tends to occur. The proper spacing between the baffle and the conduit must be determined for each unit according to its size and capacity.

DE AS 17 92 660 B2 is related to a method and a device for mixing amine and phosgene to an isocyanate. According to this method a flow of amine and phosgene are guided coaxially, respectively. A cone-shaped element is provided allowing for adjusting the gap-width depending on the agglomeration of products on the gap. The cone is adjustable in axial direction thus allowing for changing the gap. By changing of the gap, the angles in which jets can be induced are adjustable between 45° till 60°.

Any solids which deposit at the edges of the mixing space can be removed by means of cleaning pins which can be installed in a movable fashion in the feed point. EP-0 830 894 A1 discloses such a solution. The aim of the cleaning pin, which represents a movable component, is to keep the feed point free of deposits, but, if the highly toxic phosgene is one of the reactants, it creates an increased safety risk, as mentioned above, due to a new potential point of escape for the phosgene. Although this solution makes it possible to remove deposits of solids from the mixing space by means of the cleaning pin, this is at the cost of a leakage risk in the form of the bearing of the movable cleaning pin.

It is an object of the present invention to provide a mixing process using static components by means of which organic monoisocyanates or polyisocyanates can be prepared continuously and without deposits while avoiding the formation of by-products.

We have found that this object is achieved by, in a process for mixing reactant streams to produce a product stream, using a mixing configuration having a number of reactant feed points and dividing an excess component stream into two reactant substreams which are fed into the suction region of the mixing space to which a deficient component with which mixing is to occur is fed.

The division of the excess component stream into two reactant substreams which can be fed separately to the mixing space shortens the mixing time of the excess stream molecules with the deficient component by shortening the transverse diffusion paths; the transverse diffusion of the deficient component stream into the excess component stream is also shortened drastically, so that more rapid mixing can be achieved while avoiding by-product formation and deposits. The targeted injection of the excess component into the suction region of a free stream of the deficient component entering the end face of the mixing space enables the deficient component to be surrounded by the excess component streams in the mixing space, so that the excess component is also present in excess in the wall regions of the mixing space and no deposits on the walls as a result of by-product formation are possible.

In a further embodiment of the process of the present invention for mixing two reactant streams, the split ratio of the excess component stream, fed in via two separate lines, can be set to 1:1, so that the reactant substreams can be fed to the mixing space as an inner annular jet and an outer annular jet. The split ratio of the reactant substreams of the excess component can be varied within wide limits; thus, the mass flow ratios of inner reactant substream to outer reactant substream can vary within the range from 0.01 to 1 or the range from 100 to 1 in order to influence the mixing process as a function of excess component and deficient component chosen.

In the mixing process proposed according to the present invention, the separate reactant substreams can be fed into the mixing space at an angle ranging from 1° to 179°. To bring about very pronounced transverse diffusion between excess and deficient components, the reactant substreams are preferably fed in at an angle of 90° relative to the deficient component coming from the end face of the mixing space. In the process proposed according to the present invention, the throughput can be increased by adjusting the inner radius of the wall bounding the mixing space on the inside and the outer radius of the wall bounding the mixing space on the outside so as to produce an increased interior cross-sectional area for mixing and for downstream product discharge while maintaining a constant longitudinal velocity and a constant gap width between the surfaces bounding the mixing space.

In the process proposed according to the present invention for mixing two reactant streams, mixing can be accelerated by the installation of elements which generate a twisting motion, in, for example, the feed lines for the substreams of the excess component into the mixing space. Such a twist-generating element would be, for example, a helically twisted strip or the like set into the feed line.

In a further embodiment of the mixing apparatus of the present invention, both the reactant feed points and the mixing space are configured as annular gaps and the feed point for one of the reactant streams is located at the end face of the mixing space. The mixing space itself can be configured as an annular gap which has an adjustable gap between its boundary surfaces. The feed points for the reactant streams, which open into the mixing space, can likewise advantageously be configured as gaps running radially, where the length of the mixing space is preferably in the range from 7 to 10 gap widths.

The invention will now be described in more detail with the aid of the drawing.

Figure 1:
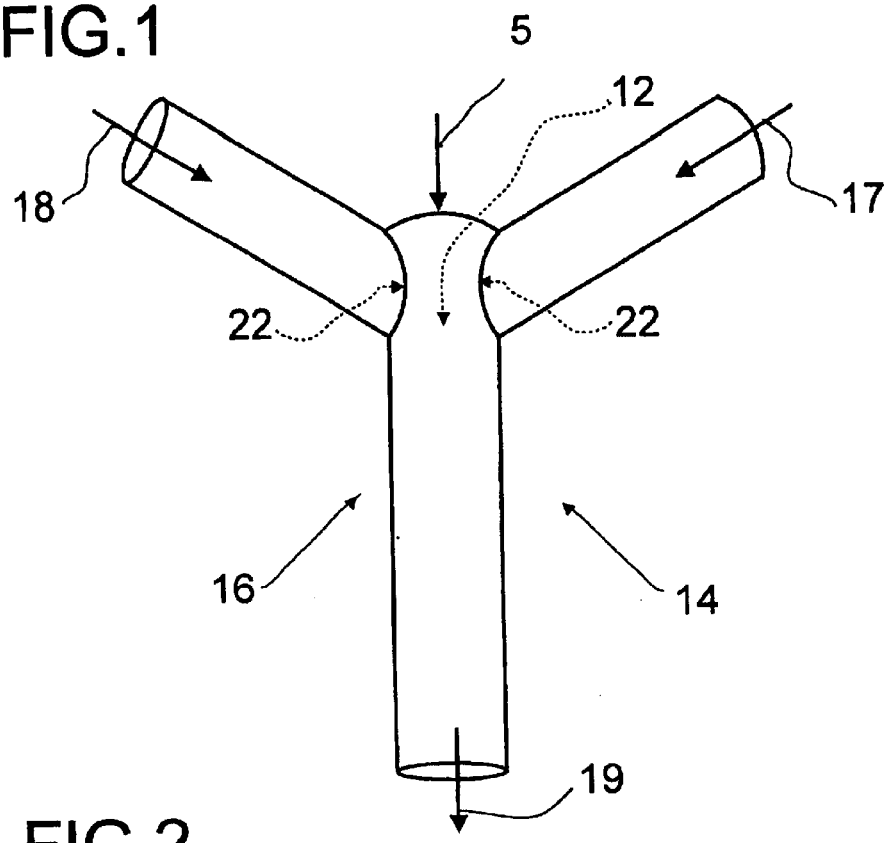
FIG. 1 shows a Y-shaped mixing apparatus.

The embodiment of a mixing apparatus shown in FIG. 1 is a Y-shaped mixing apparatus.

The Y-shaped mixing configuration 16 in FIG. 1 shows the two feed lines which supply the mixing space 12 with respective excess component substreams. Reactant substreams enter the feed lines at the input points 17, 18. At their respective mouth 22, the feed lines are connected to the mixing space 12. The deficient component 5, for example amine flowing through an axial annular gap, enters the mixing space 12 (whose configuration is not shown in more detail in FIG. 1) at its end face. The mixing space 12 of the Y-shaped mixing configuration 16 is adjoined by a continuation of the mixing space 12 having a particular length 14. The continuation 14 of the mixing space 12 is adjoined by the transport section for the product stream 10 which leaves the Y-shaped mixing configuration at the product outlet 19.

A mixing process occurring in a Y-shaped mixing configuration 16 is described in the following example: about 420 kg/h of 2,4-toluenediamine (TDA) are premixed as a solution in 2450 kg/h of o-dichlorobenzene (ODB) and introduced together with 8100 kg/h of a 65% strength phosgene solution into the mixing apparatus shown. In the present example, the phosgene is the excess component while the TDA dissolved in dichlorobenzene is the deficient component 5. The phosgene solution streams can be divided in a ratio of 1:1 in the feed lines at the reactant feed points 17 and 18, with the inlet diameter of the mixing apparatus and the gap width between the surfaces bounding the mixing space being selected so that a mean entry velocity of the excess component phosgene and the deficient component amine of about 10 m/s and an exit velocity of the product stream 19 of about 10 m/s are established. After phosgenation to clarity and work-up by distillation, a product yield of about 97% was obtained.

Figure 2:
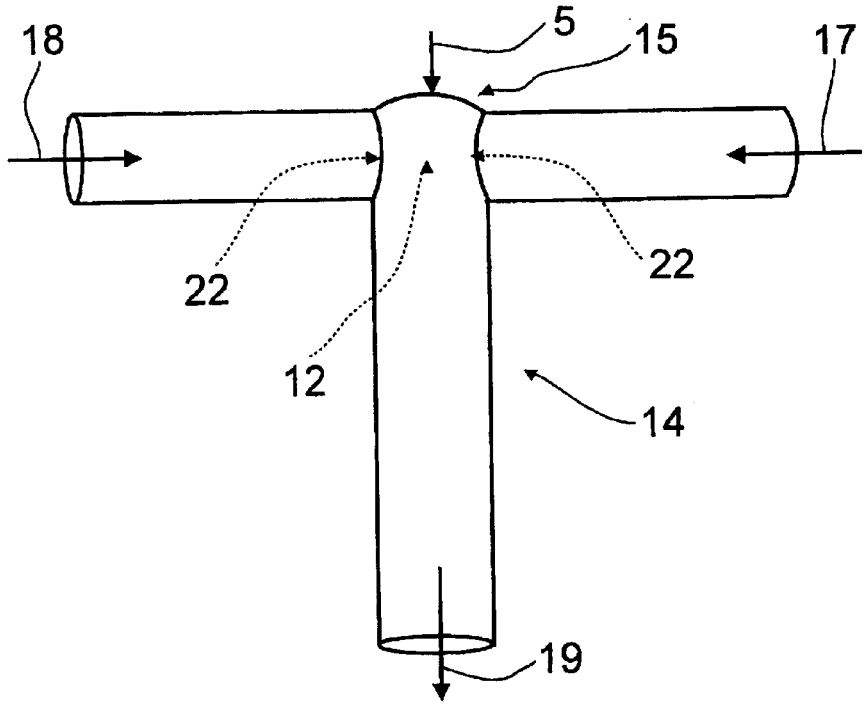
FIG. 2 shows a T-shaped mixing configuration.

FIG. 2 shows a T-shaped mixing configuration.

In this mixing configuration, too, the reactant substreams, for instance phosgene, enter the feed lines at the product feed points 17, 18 and go from here to the mixing space 12 which is not shown in more detail. At the end face of the mixing space 12, there is a feed line configured as an axial annular gap for a deficient component, in the present example for amine which is dissolved in liquid dichlorobenzene. In the present example shown in FIG. 2, the two reactant substreams enter the mixing space at an angle of 90° relative to the axis of the mixing space 12 extending downward along its continuation 14 and bring about a mixing reaction which is quickly established due to the extremely short transverse diffusion paths. The mixture obtained, namely the product 19, flows in the direction of the downward-extending mixing space length 14 in the direction of the product outlet 19, where the product 10 leaves the T-shaped mixing configuration 15 shown.

The two feed lines which carry the reactant substreams, for instance phosgene, via the product feed points 17 and 18 of the feed lines in the direction of the mouths 22 can be provided with components which generate a twisting motion, for example helical internals. The twist-generating components accelerate a mixing reaction of the two reactant streams of the excess component with the deficient component, for example the amine, entering at the end face of the mixing space 12.

Figure 3:
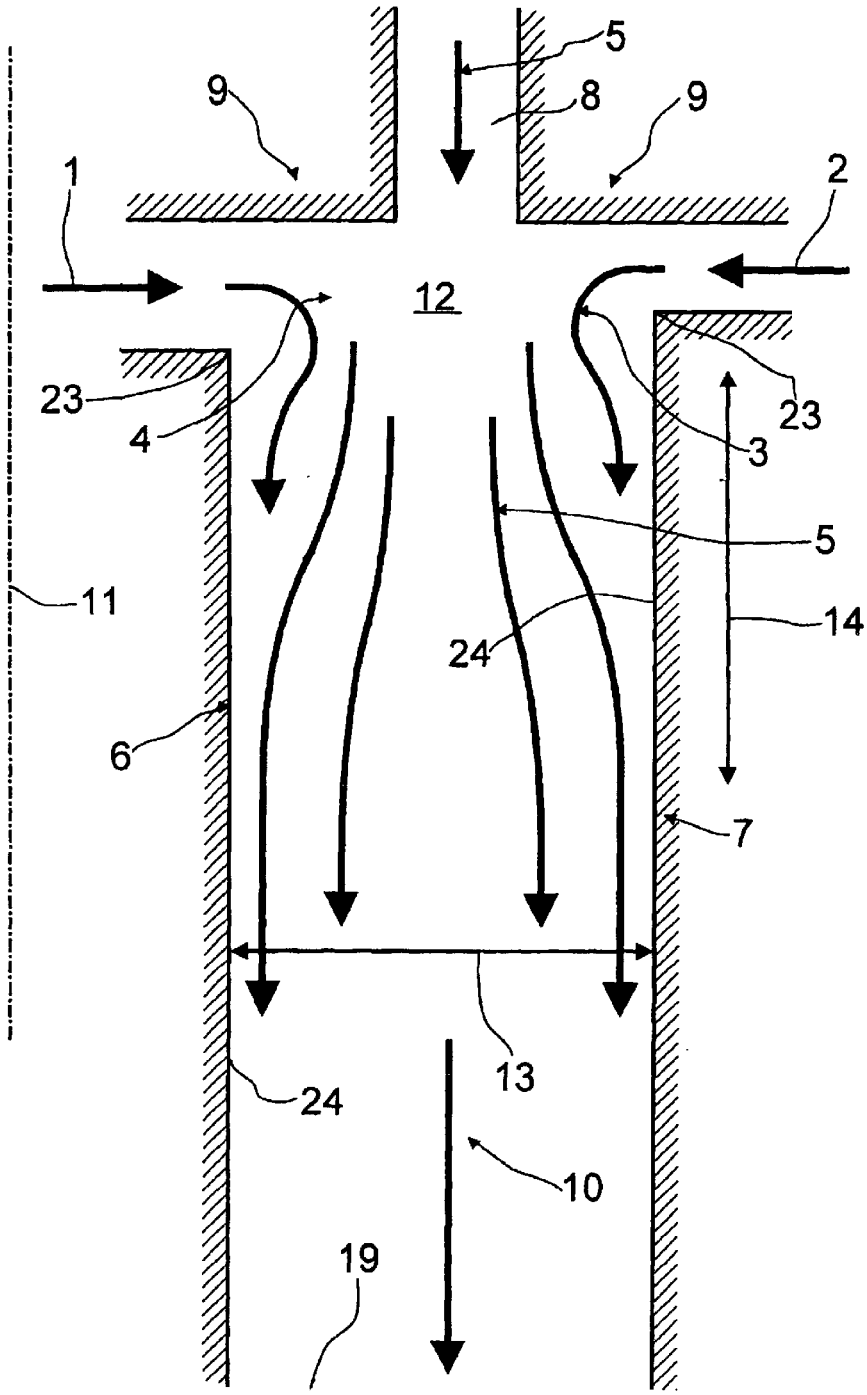
FIG. 3 shows a mixing space in the form of an annular gap with radial inlet openings for excess component substreams and FIG. 4 shows a twisted element located in a feed line to the mixing space.

FIG. 3 shows an annular mixing space with radial inlet openings for substreams of excess component.

In the configuration shown in FIG. 3, there is an opening 8 configured as an axial annular gap through which a deficient component 5 enters the mixing space 12 located in the end face 9 of the mixing space 12. The deficient component 5 leaves the opening 8 essentially as a free jet and as it exits from the end face 9 generates an outer suction region 3 and an inner suction region 4. In relation to the line of symmetry 11 of the mixing apparatus, the inner suction region 4 is the suction region of the mixing space 12 which is closer to the line of symmetry 11, while the outer suction region 3 is the suction region of the mixing space 12 which is located further from the line of symmetry 11. In the illustrative embodiment shown in FIG. 3, the reactant substreams 1 and 2 of the phosgene, each excess component, enter the mixing space 12 at the end face 9 as inner annular jet 1 and as outer annular jet 2, respectively, at an angle of preferably 90°. The end face 9 of the mixing space 12 does not have to be flat, but can in sections be conical or have a concave or convex curvature. The edges 23 of the surfaces bounding the mixing space length 14 and located opposite the end face 9 are preferably rounded so that no turbulence and dead zones are formed at the beginning of the mixing space 12. The lateral surfaces 6 and 7 bounding the mixing space 12 in the axial direction 14 are ideally configured as cylindrical walls. However, sections of them can also be in the form of a cone or a concave or convex widening or narrowing. Such shaping of the walls bounding the mixing space length 14 enables a continuous transition from the outer boundary surface 7 to the tube system connected to the mixing apparatus to be achieved.

When the deficient component 5 coming from the annular opening 8 and the excess component of the inner annular jet 1 and the excess component of the outer annular jet 2 meet in the mixing space 12, extremely fast transverse diffusion of the molecules of the excess component phosgene and those of the deficient component amine occurs. The jet of deficient component 5 leaving the annular gap 8 as a free jet is surrounded within the outer suction region 3 and the inner suction region 4 by the excess component substreams 1 and 2, so that there is an excess of excess component at the walls 6 and 7 bounding the mixing space 12, so that no deposits can form there even in the reduced-pressure regions 3 and 4.

In the process of the present invention for mixing reactant streams, which can be used, for example, for the phosgenation of amines or for the precipitation of vitamins, the excess component stream is divided into two reactant substreams 1, 2. The reactant substreams 1, 2 of the excess component are mixed in an annular mixing space 12 with a deficient component injected, for example, at right angles to these reactant substreams. The reactant substreams 1, 2 of the excess component are preferably mixed into the suction regions 3, 4 of the deficient component stream 5 exiting a nozzle as a free jet. The nonparallel injection of deficient component 5 as a free jet and the reactant substreams 1, 2, for example at an angle of 90° to the injection direction of the deficient component, into the annular mixing space 12 makes it possible to achieve efficient turbulence and avoid laminar flow through the mixing space 12. The nonparallel injection at any angles from 0° to 180° makes it possible to achieve transverse diffusion and transverse exchange processes between the reactant substreams 1, 2 and the deficient component stream 5 injected in a longitudinal direction into the mixing space 12, which are highly beneficial to mixing.

In the illustrative embodiment shown, the feed openings for the inner annular jet 1, the outer annular jet 2 and for the deficient component at the end face 9 are in each case configured as annular gaps. As an alternative, they can be configured as a series of closely spaced drilled holes. The orientation of the openings relative to the mixing space 12, here at an angle of 90° to one another, can also be at different angles: the inlet openings for the excess components relative to the free jet of the deficient component 8 can be at an angle in the range from 1 to 179° to one another. The feed points, i.e. the mouths 22 of the feed lines into the mixing space 12 as shown in FIGS. 1 and 2, should be chosen so that virtually no back mixing which brings product-rich fluid into contact with reactant-rich fluid occurs in the mixing apparatus, since this entails the risk of by-product formation, for example formation of ureas. If the inner boundary surface 24 of an interior cylindrical element 6 is configured as a core whose radius can be increased when the throughput through the proposed mixing apparatus is increased, the throughput can be increased by means of an enlarged cross-sectional area of the mixing apparatus while maintaining a constant longitudinal velocity and a constant gap width. Since the transverse diffusion path and, owing to the equal velocity gradients, the turbulent transverse diffusion remains constant, constant longitudinal velocities, for instance 10 m/s, through the mixing apparatus of the present invention result in constant mixing times at a constant specific power input into the mixing apparatus.

Thus, the process proposed according to the present invention is, within wide limits, independent of the throughput, so that the process of the present invention can be readily scaled up. The length 14 of the mixing space 12 extending from the end face 9 of the mixing space is at least half a gap width and not more than 200 gap widths 13, with the length of the mixing space adjoining the end face 9 preferably being in the range from 3 to 10 gap widths 13. The mixing space length 14 is followed, as shown in FIGS. 1 and 2, by the product outlet 19 through which the product 10 leaves the mixing configuration of the present invention to pass through further processing steps.

Figure 4:
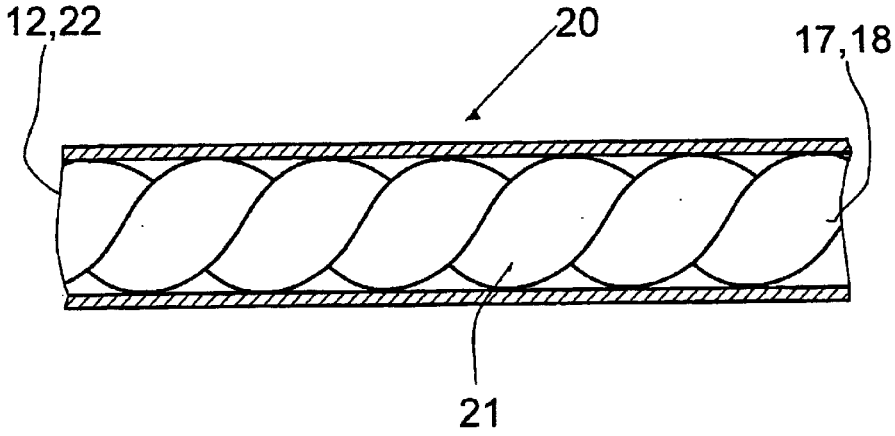

FIG. 4 shows a twist-generating element located in a feed line of the mixing space 12.

In the process of the present invention for mixing reactant streams, it is possible for twist-generating elements 21 to be installed in the feed lines 20 which each open at their mouths 22 into the mixing space 12. On exiting from the mouth 22 into the mixing space 12, the mixing energy liberated during the mixing process by the reduction in the twisting motion in the mixing space 12 can be utilized for accelerating the mixing process. As twist-generating element 22, it is possible, for example, to integrate a twisted strip or a helix into the feed line 20. The use of a helical element would at the same time have the advantage of being able to be used for fixing the inner cylinder 6 which is closest to the line of symmetry 11 of the mixing apparatus.

| List of reference numerals | |
|---|---|
| 1 | Inner annular jet (excess component) |
| 2 | Outer annular jet (excess component) |
| 3 | Outer suction region |
| 4 | Inner suction region |
| 5 | Deficient component |
| 6 | Inner cylinder |
| 7 | Outer cylinder |
| 8 | Axial annular opening |
| 9 | End face of mixing space |
| 10 | Product stream |
| 11 | Line of symmetry |
| 12 | Mixing space |
| 13 | Width of mixing space |
| 14 | Length of mixing space |

-continued

| List of reference numerals | |
|---|---|
| 15 | T configuration |
| 16 | Y configuration |
| 17 | Reactant inlet |
| 18 | Reactant inlet |
| 19 | Product outlet |
| 20 | Feed line |
| 21 | Twisting element |
| 22 | Mouth |
| 23 | Edge |
| 24 | Wall |

We claim:

1. A process for mixing reactant streams containing a stream of a deficient component and a stream of an excess component comprising the following process steps:

providing a mixing space (12) having an end face (9) and an inner wall (6) and an outer wall (7) defining an annular shape therebetween, injection the deficient component into the mixing space (12) as an annular shape such that the deficient component generates an outer suction region (3) and an inner suction region (4) within the mixing space (12), dividing the stream of the excess component into at least two reactant substreams, nonparallelly injecting the reactant substreams into the outer and the inner suction regions (3, 4) generated by the deficient component for mixing the reactant substreams of the excess component and the deficient component in the mixing space.

2. The process as claimed in claim 1, wherein at least one reactant substream of the excess component is injected from the inner wall (6) as an annular shape and at least one reactant substream of the excess component is injected from the outer wall (7) as an annular shape into the mixing space.

3. The process as claimed in claim 1, wherein the split ratio of the reactant substreams is between 0.01 and 100 to 1.

4. The process as claimed in claim 1, wherein the reactant substreams are fed to the annular mixing space at an angle in the range from 1° to 179° relative to the free jet of the deficient component.

5. The process as claimed in claim 4, wherein the angle is 90°.

6. An apparatus for mixing an excess component with a deficient component (5) to produce a product stream (10), said apparatus comprising:

a mixing space (12) having an end face (9) and an inner wall (6) and an outer wall (7) defining an annular shape therebetween, wherein said annular shape extends along a length (14);

a feed point (8) extending axially around said end face (9) for injecting the deficient component (5) as an annular shape into said mixing space (12) such that the deficient component (5) generates an inner suction region (4) and an outer suction region (3) within said mixing space (12);

an inner reactant feed (1) opening into said mixing space (12) through said inner wall (6) and adjacent said end face (9) for injecting the excess component into said inner suction region (4);

an outer reactant feed (2) opening into said mixing space (12) through said outer wall (7) and adjacent said end face (9) for injecting the excess component into said outer suction region (3);

wherein said inner and said outer reactant feeds (1, 2) allow for nonparallel injection of the excess component relative to the deficient component (5).

7. The apparatus as claimed in claim 6, wherein the mixing space (12) has a common line of symmetry (11) with the inner and outer walls (6, 7) being cylindrical or in some sections conical, concave or convex.

8. The apparatus as claimed in claim 7, wherein the mixing space (12) has a gap width (13) between the walls (6, 7) and the length (14) of the mixing space (12) is in the range from half a gap width (13) to 200 gap widths (13).

9. The apparatus as claimed in claim 8, wherein the length (14) of the mixing space (12) is in the range from 3 to 10 gap widths (13).

10. The apparatus as set forth in claim 6, wherein said inner and said outer reactant feeds (1, 2) abut said end face (9).

11. The apparatus as set forth in claim 6, wherein said inner and said outer reactant feeds (1, 2) extend axially around said mixing space (12) for introducing the excess component as an annular shape.

12. The apparatus as set forth in claim 6, wherein said feed point (8) is generally centrally located within said end face (9) for creating said inner and said outer suction regions (4, 3) within said mixing space (12).

13. The apparatus as set forth in claim 6, wherein said reactant feeds (1, 2) are fed to said mixing space (12) at an angle in the range from 1° to 179° relative to the deficient component (5).

14. The apparatus as set forth in claim 6, wherein said annular shape of said mixing space extends from said end face (9) for said entire length (14).

* * * * *